US006076650A

United States Patent [19]

Schwarzli

[11] Patent Number: 6,076,650

[45] **Date of Patent: *Jun. 20, 2000**

[54] COIN MECHANISM WITH COIN SLOT BLOCKING SYSTEM

[75] Inventor: Josef W. Schwarzli, Stouffville, Canada

[73] Assignee: Machine-O-Matic Limited, Newmarket, Canada

[ * ] Notice: This patent is subject to a terminal disclaimer.

[21] Appl. No.: 09/055,753

[22] Filed: Apr. 7, 1998

Related U.S. Application Data

[60] Continuation-in-part of application No. 08/893,308, Jul. 15, 1997, Pat. No. 5,924,542, which is a division of application No. 08/574,503, Dec. 19, 1995, Pat. No. 5,657,848, which is a continuation of application No. 08/237,529, May 3, 1994, abandoned.

[30] Foreign Application Priority Data

Apr. 8, 1994 [CA] Canada ..... 2120904

[51] Int. Cl.[7] ..... G07F 11/44

[52] U.S. Cl. ..... 194/292; 194/351

[58] Field of Search ..... 194/236, 237, 194/255, 292, 351

[56] References Cited

U.S. PATENT DOCUMENTS

| | | | |
|---|---|---|---|
| 1,193,967 | 8/1916 | Antoine et al. . | |
| 2,069,200 | 2/1937 | Ackley | 194/351 X |
| 2,266,666 | 12/1941 | Thomas | 194/351 X |
| 2,666,514 | 1/1954 | Stewart | 194/236 |
| 3,010,557 | 11/1961 | Weitzman | 194/63 |
| 3,227,257 | 1/1966 | Probasco | 194/61 |
| 3,506,104 | 4/1970 | Kaiser et al. | 194/335 |
| 3,620,342 | 11/1971 | Prescott | 194/236 |
| 3,937,314 | 2/1976 | Rosenberg | 194/63 |
| 4,363,393 | 12/1982 | McDonald | 194/237 |
| 4,899,864 | 2/1990 | Van Horn | 194/237 |
| 5,174,427 | 12/1992 | Glaser | 194/236 |
| 5,188,207 | 2/1993 | Hoffman | 194/236 |
| 5,259,532 | 11/1993 | Schwarzli | 221/304 |
| 5,383,545 | 1/1995 | Schwarzli | 194/236 X |

FOREIGN PATENT DOCUMENTS

| | | | |
|---|---|---|---|
| 929396 | of 0000 | United Kingdom | 194/236 |

*Primary Examiner*—F. J. Bartuska
*Attorney, Agent, or Firm*—Dimock Stratton Clarizio; Mark B. Eisen

[57] ABSTRACT

A coin mechanism for a vender includes a blocking member biased to a rest position retracted from the coin slot, and pivotable between the rest position and a blocking position in which the blocking member substantially covers the coin slot. The blocking member cooperates with a rotatable member which forces the blocking member into the blocking position upon rotation of the handle.

20 Claims, 6 Drawing Sheets

COIN MECHANISM WITH COIN SLOT BLOCKING SYSTEM

This application is a continuation-in-part of application Ser. No. 08/893,308 filed Jul. 15, 1997 now U.S. Pat. No. 5,924,542, which is a division of application Ser. No. 08/574,503 filed Dec. 19, 1995, now U.S. Pat. No. 5,657,848 which is a continuation of application Ser. No. 08/237,529 filed May 3, 1994 now abandoned.

FIELD OF INVENTION

The present invention relates to coin mechanisms. In particular, the present invention relates to a security feature in a rotary coin mechanism which blocks access to the coin slot when the mechanism is in use.

BACKGROUND OF THE INVENTION

Bulk venders are widely used for vending a wide variety of merchandise, from confectionaries to toys. Part of the appeal of bulk venders is that they attract very little overhead in terms of both space and labour. Bulk venders are typically located in high-traffic public areas, and require only periodic servicing to collect deposited coins, refill the product storage bin and, occasionally, to repair or replace parts. As such they are ideal for "self-service" sales of small articles.

For the same reasons, however, bulk venders are frequently subjected to abuse, and particularly to attempts to defeat the coin mechanism and obtain free merchandise. Many types of safety features have been developed over the years to prevent the theft of merchandise from bulk venders, including diameter measuring devices capable of measuring the diameter of a deposited coin to precise tolerances, which cooperate with the coin conveyor to prevent rotation of the mechanism unless the deposited coin is of the correct size.

A typical diameter measuring device comprises a dog pivotally mounted inside the cover plate, so that a coin of the correct diameter contacts the dog and raises the dog to a position at which the mechanism can be rotated about the dispensing cycle. This presents a difficult problem in a conventional coin mechanism. The amount of "play" in the mechanism, i.e. the extent to which the handle can be turned without the correct coin being deposited, must be minimal in order to avoid exposing merchandise to the entrance of the dispensing chute without the proper coin being deposited (commonly known as "milking" the vender). To avoid this the coin must be measured for proper size as close as possible to the beginning of the turning cycle. Thus, if the coin is not the correct size or if no coin has been deposited the handle cannot be turned far enough to expose merchandise to the dispensing chute.

However, this requires that the diameter measuring dog be positioned close to the coin slot. In such a coin mechanism the coin slot provides an access point into the interior of the mechanism. As the coin conveyor is rotated slightly past the rest position the coin recess provides an opening from the coin slot to the diameter measuring dog, such that a wire inserted through the coin slot can be manoeuvred to raise the measuring dog to the correct position, allowing the mechanism to be rotated without a coin being deposited.

SUMMARY OF THE INVENTION

The present invention overcomes this problem by providing a blocking member which is actuated by a cam to block access to the coin slot as the coin conveyor is rotated beyond the rest position. As the coin recess is rotated toward the diameter measuring dog the blocking member impinges into the coin slot, preventing a wire or tool from being inserted into the mechanism interior and thus preventing the mechanism from being defeated in this fashion.

The present invention thus provides a coin mechanism comprising a cover plate having a coin slot, a coin conveyor having a coin recess in alignment with the coin slot when the coin conveyor is in a rest position, a handle for rotating the coin conveyor, engaged to a drive gear by a shaft, a measuring device for preventing rotation of the handle substantially beyond the rest position unless a coin of the correct size is deposited into the coin recess, and a blocking member biased to a rest position retracted from the coin slot and pivotable between the rest position and a blocking position in which the blocking member substantially covers the coin slot, the blocking member cooperating with a rotatable member which forces the blocking member into the blocking position upon rotation of the handle.

The present invention further provides a vending machine having a coin mechanism, the coin mechanism comprising a cover plate having a coin slot, a coin conveyor having a coin recess in alignment with the coin slot when the coin conveyor is in a rest position, a handle for rotating the coin conveyor, engaged to a drive gear by a shaft, a measuring device for preventing rotation of the handle substantially beyond the rest position unless a coin of the correct size is deposited into the coin recess, and a blocking member biased to a rest position retracted from the coin slot and pivotable between the rest position and a blocking position in which the blocking member substantially covers the coin slot, the blocking member cooperating with a rotatable member which forces the blocking member into the blocking position upon rotation of the handle.

BRIEF DESCRIPTION OF THE DRAWINGS

In drawings which illustrate by way of example only a preferred embodiment of the invention.

DETAILED DESCRIPTION OF THE INVENTION

Figure 1:
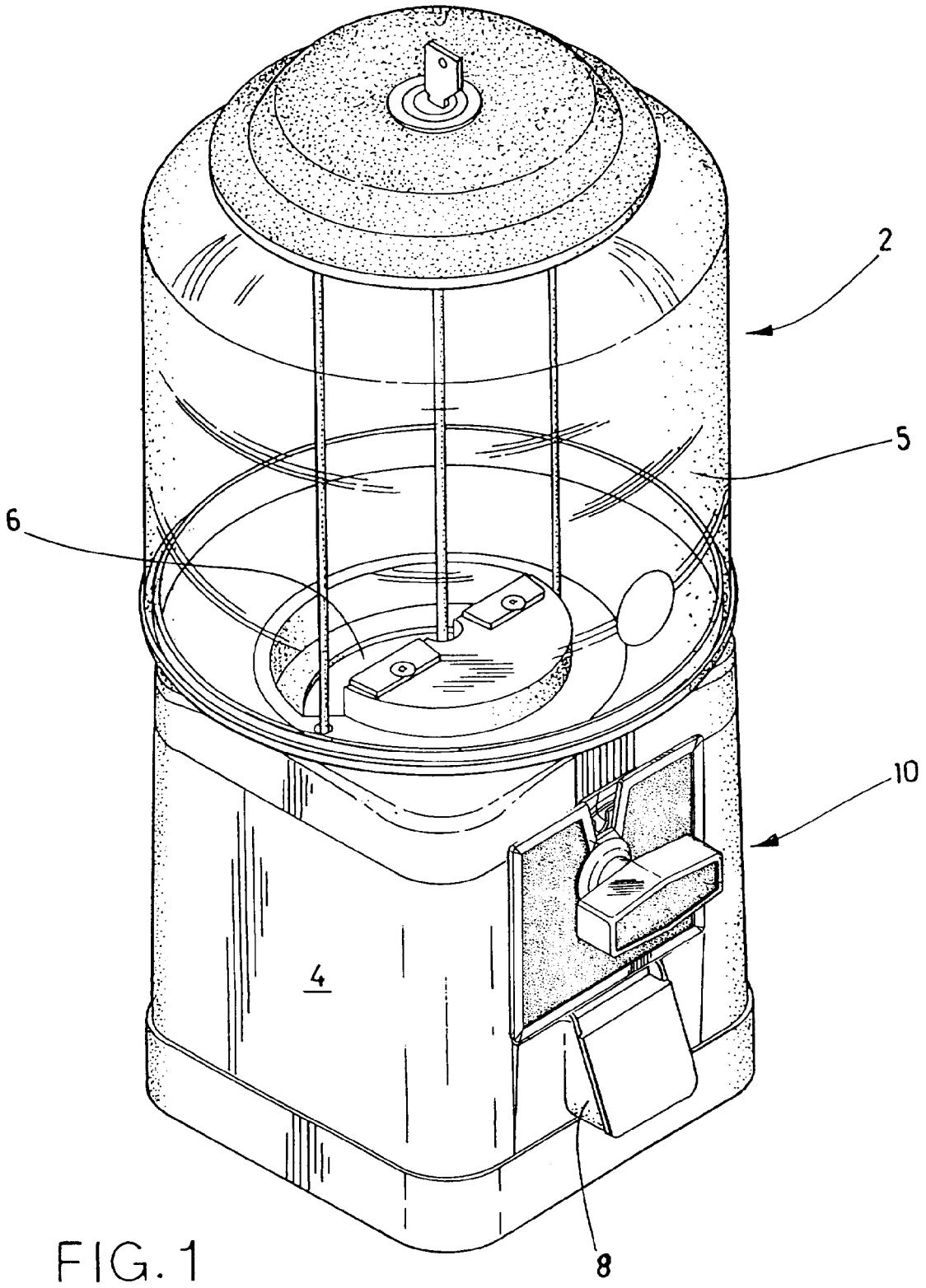
FIG. 1 is a perspective view of a bulk vender having a coin mechanism embodying the invention.
Figure 2:
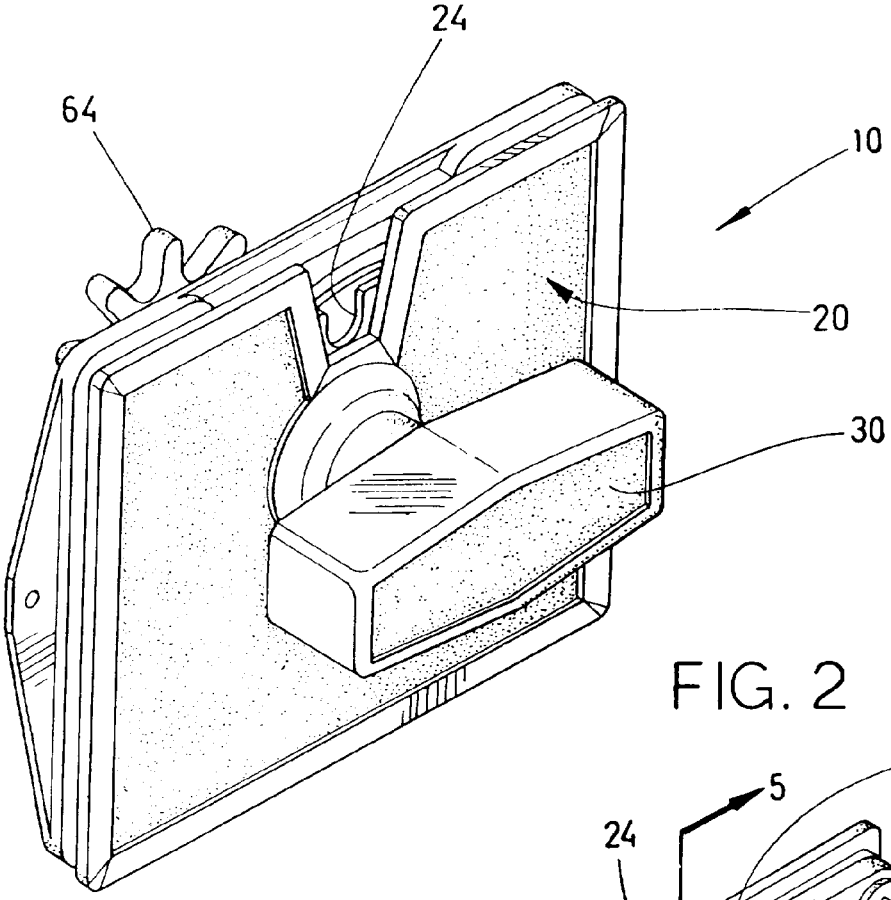
FIG. 2 is a front perspective view of a coin mechanism embodying the invention.
Figure 3:
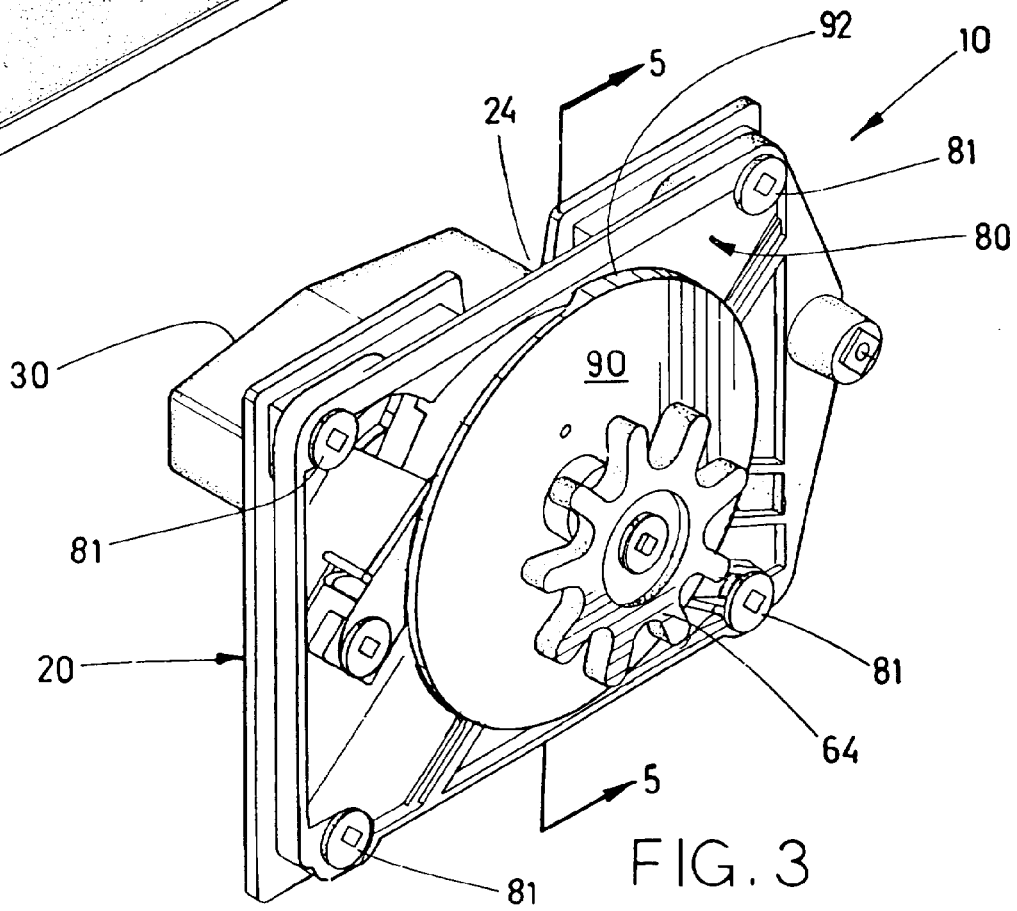
FIG. 3 is a rear perspective view of the coin mechanism of FIG. 2.
Figure 4:
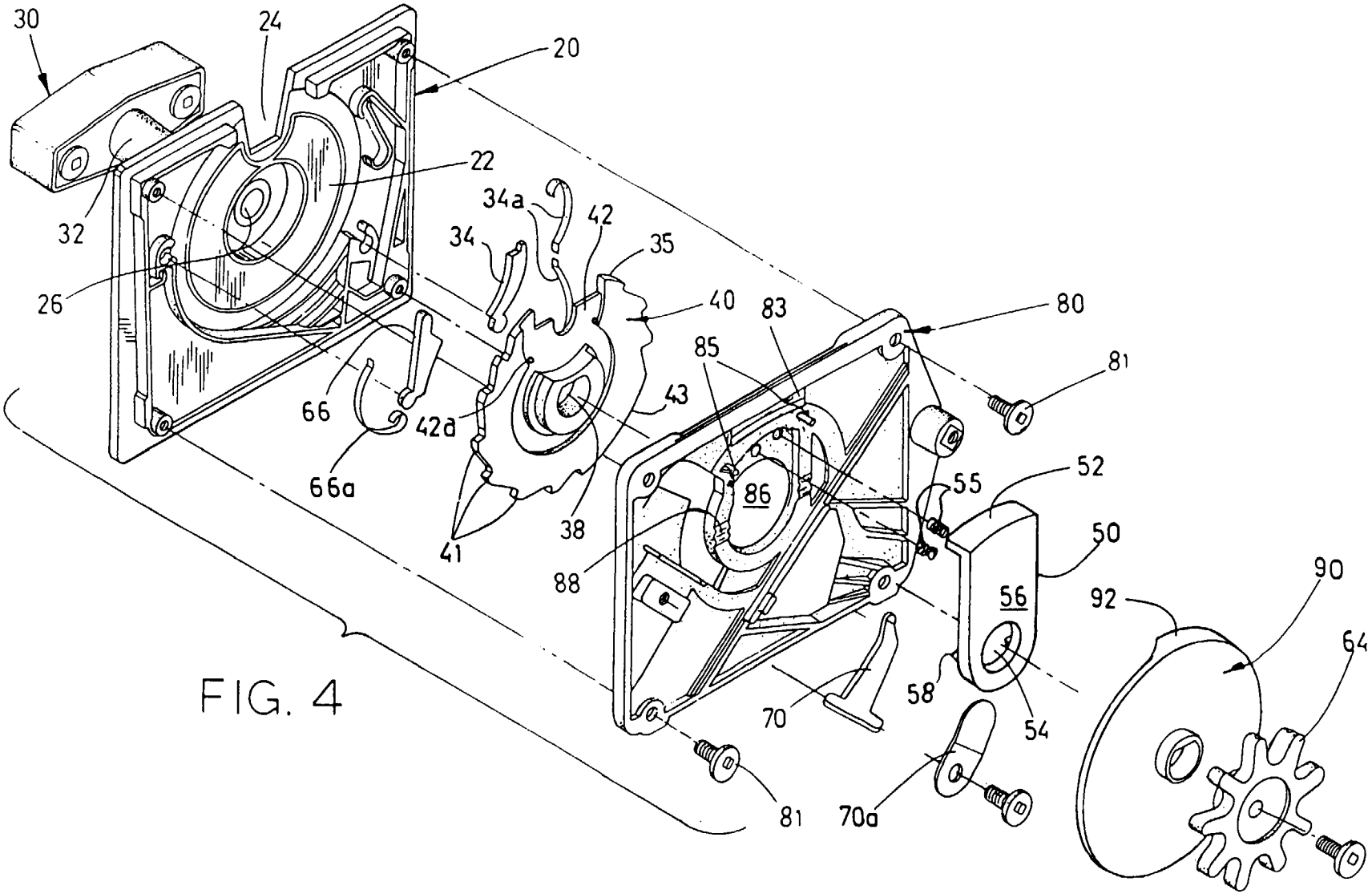
FIG. 4 is an exploded view of the coin mechanism of FIG. 2.

FIG. 1 illustrates a merchandise-dispensing apparatus commonly known as a bulk vender 2 in which the coin mechanism 10 of the invention may be employed. The vender 2 conventionally includes a lower housing 4 enclosing the workings of the coin mechanism and a cash box (not shown) for collecting deposited coins or tokens 1, a transparent article storage bin 5 for storing merchandise such as gum balls or other articles to be dispensed, and a dispensing wheel 6 which is rotated by rotation of the coin mechanism 10 to align one of a plurality of product carriers with the opening to a dispensing chute 8, as is well known.

A preferred embodiment of the invention is illustrated in FIGS. 2 to 9. The mechanism 10 comprises a cover plate 20 having a coin slot 24, a circular recess 22 in its rear face (seen in FIG. 4) in which a substantially disc-shaped coin conveyor 40 rotates, and an opening 26 centred in the recess 22. The handle 30 is fixed to a tapered shaft 32 which extends through the opening 26 and engages an opening 38 disposed through the centre of the coin conveyor 40. The shaft 32 has a longitudinal flat (or slightly concave) surface 32*a* to rotationally engage the various components engaged to the shaft 32.

The coin conveyor 40 includes a coin receiving portion for receiving a coin 1, which in the preferred embodiment comprises a suitably dimensioned recess 42 in which the coin 1 nests as it is conveyed about the rotational cycle of the coin mechanism 10. The coin receiving portion may additionally (or alternatively) comprise a pair of spaced apart pins 42*a*, a ledge (not shown) or any other means capable of supporting a coin 1.

In the illustrated embodiment the coin conveyor 40 is provided with peripheral ratchet teeth 41 which cooperate with a pawl 66 biased against the teeth 41 by springs 66*a*, to prevent reverse rotation of the mechanism 10 during most of the rotational cycle. Alternatively a separate gear could be used for this purpose.

A back plate 80 overlays the coin conveyor 40 and is affixed to the cover plate 20 so as to be stationary relative thereto, as by bolts 81. The back plate 80 retains a coin 1 in the coin recess 42 along the rotational path followed by the coin 1 as the mechanism 10 is rotated. The shaft 32 extends through the opening 86 in the back plate 80 and terminates at a squared end 32*a* which engages into a square recess 64*a* formed in a drive gear 64 (see FIG. 5) for rotating the dispensing wheel 6. Thus, the cover plate 20 and back plate 80 remain stationary, while the coin conveyor 40 and drive gear 64 are fixed in position on the shaft 32 and rotate as the handle 30 is turned.

A dog 70 for measuring the thickness of a coin 1 is mounted on the back plate 80 biased against the coin recess 42 by a spring 70*a*, and catches the trailing edge of the coin recess 42 if an inserted coin or slug is thinner than the intended coin 1, to arrest rotation of the mechanism 10. Another dog 34 for measuring the diameter of the coin 1 is mounted on the cover plate 20 biased against the coin conveyor 40 by springs 34*a*, and catches the trailing upper corner of the coin recess 42 if an inserted coin or slug is smaller than the intended diameter, to arrest rotation of the mechanism 10.

It can thus be seen that a coin 1 deposited into the coin slot 24 is measured for correct size immediately downstream of the coin slot 24, before a product compartment in the dispensing wheel 6 can come into alignment with the dispensing chute. Thus, if a coin or slug is rejected, the mechanism 10 may be rotated in reverse back to the rest position shown in FIG. 5 (the coin conveyor 40 includes a toothless segment 43, seen in FIG. 4, which permits a small degree of reverse rotation at the beginning of the rotational cycle of the coin mechanism 10). If the coin 1 is of the proper size, the dog 34 will clear the coin recess 42 and the mechanism 10 can be rotated through the complete dispensing cycle.

The coin mechanism 10 described thus far is well known to those skilled in the art. The present invention provides a system for blocking access to the coin slot 24 comprising a blocking member, in the preferred embodiment a blade 52 projecting from a rocker bar 50, cooperating with a cam disc 90, as illustrated in FIGS. 5 to 9.

The rocker bar 50 includes a central opening 54 for loose-fitting engagement about the shaft 32, and a stem 56 from which the blade 52 projects generally orthogonally. The rocker bar 50 is mounted over the shaft 32 such that the blade 52 is in alignment with a notch 83 in the back plate 80, best seen in FIG. 4, which is disposed behind the coin slot 24 and preferably extends across the entire length of the coin slot 24.

In the rest position the rocker bar 50 preferably projects slightly into the notch 83, which maintains the rocker bar 50 rotationally fixed relative to the cover plate 20 (i.e. so that the rocker bar 50 does not rotate with the shaft 32) and ensures that the blade 52 remains properly aligned with the notch 83. If desired a pair of pins 85 projecting from the back plate 80 may be provided to trap the stem 56 and thus help maintain the blade 52 properly aligned with the notch 83.

Figure 5:
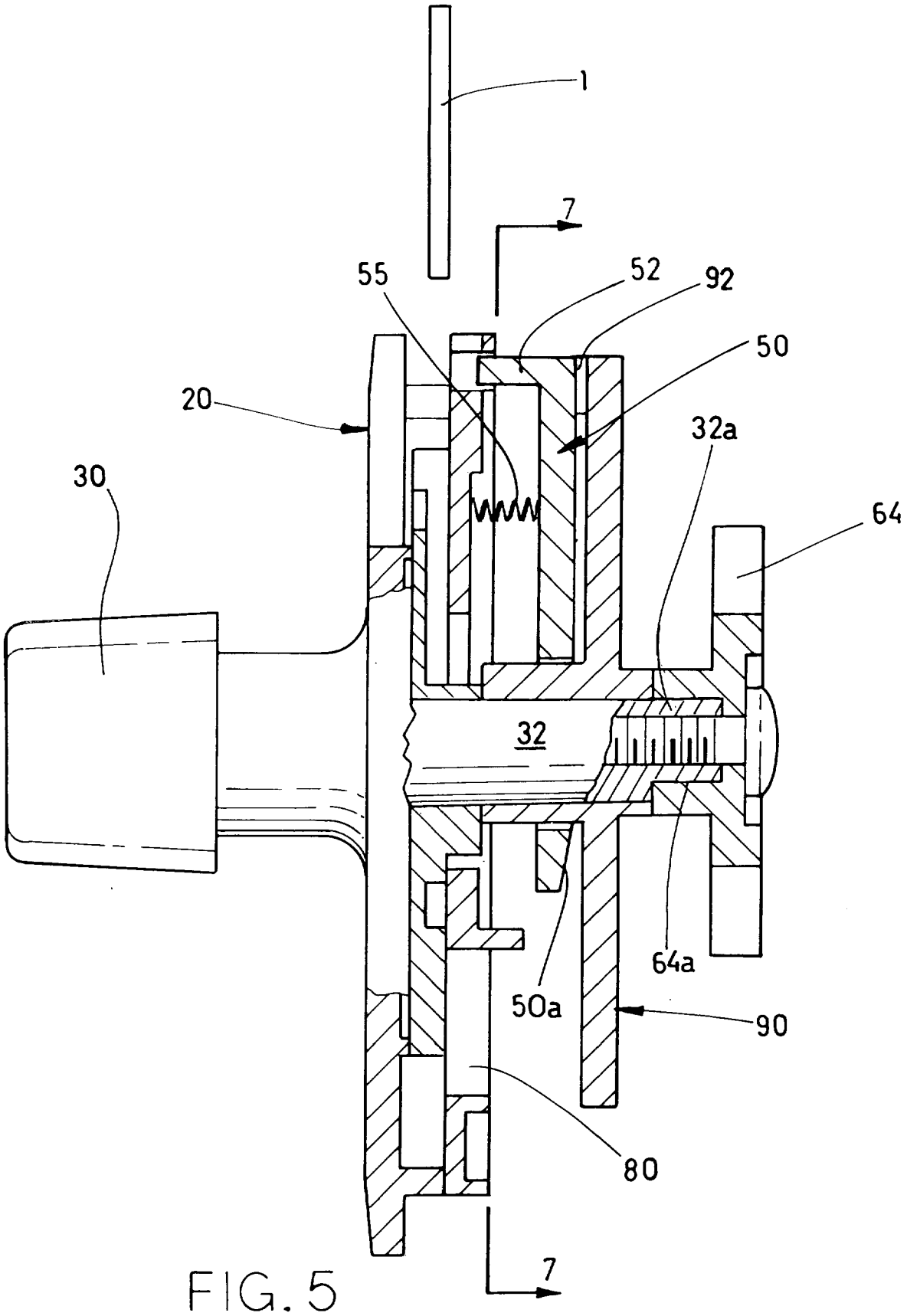
FIG. 5 is a cross-section of the coin mechanism of FIG. 2 showing the mechanism in a rest position.
Figure 6:
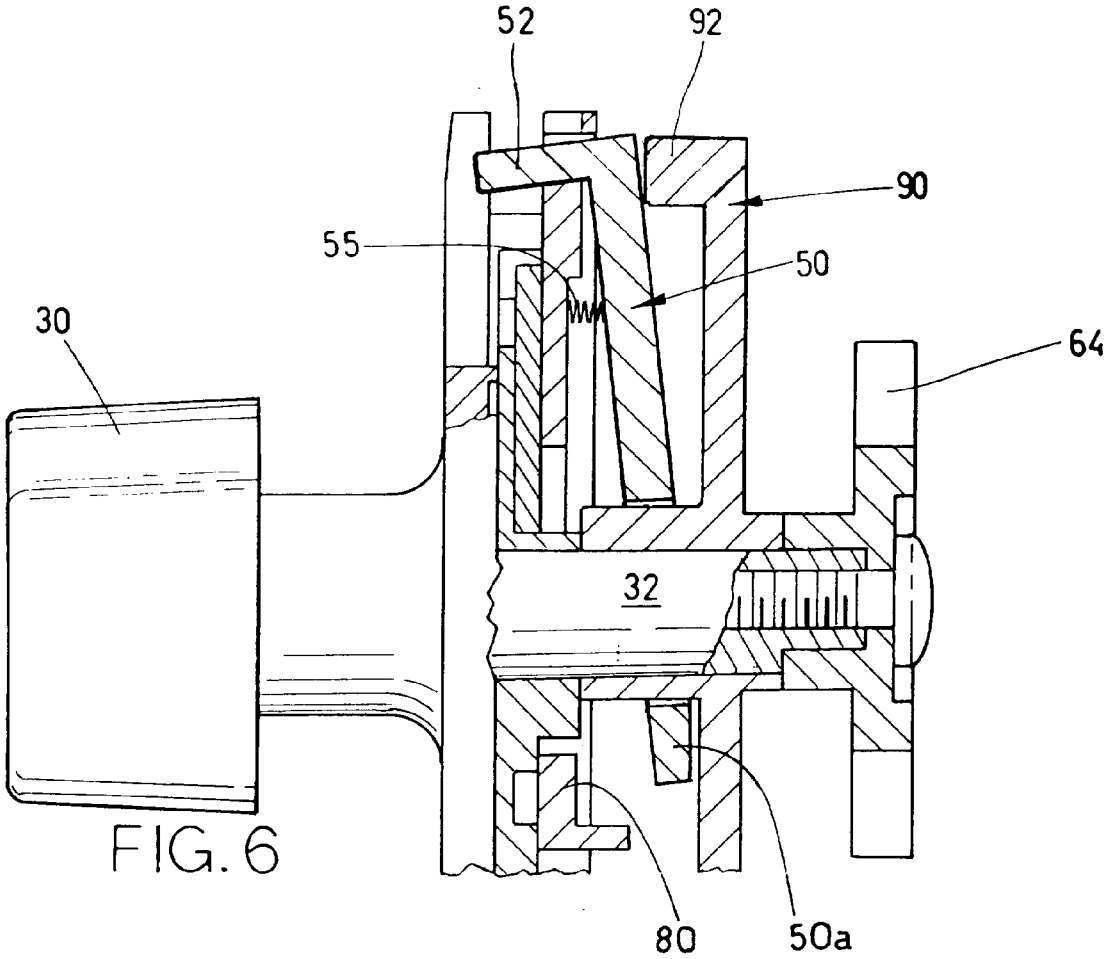
FIG. 6 is a cross-section of the coin mechanism of FIG. 2 showing the mechanism in a partially rotated position.

The rocker bar 50 can thus pivot between a retracted position in which the blade 52 is retracted from the coin slot 24, as shown in FIG. 5, and a blocking position in which the blade 52 protrudes through the notch 83 in the back plate 80 and projects over the coin slot 24, blocking access through the coin slot 24, as shown in FIG. 6.

Figure 7:
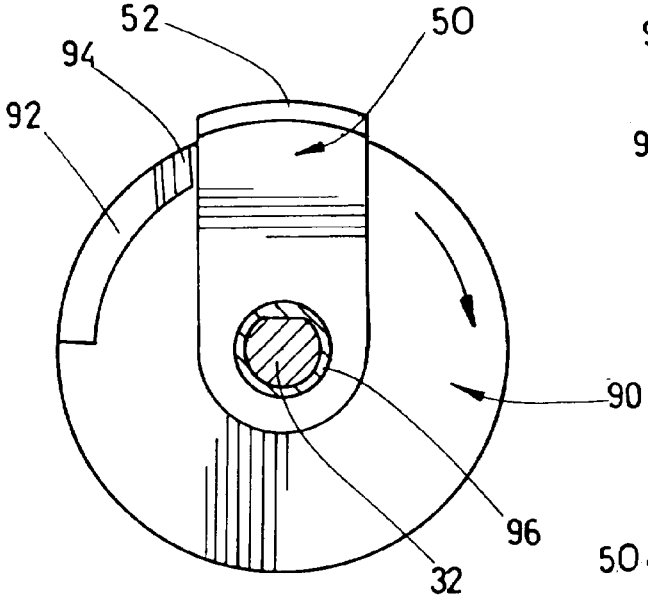
FIG. 7 is a front elevation of the blocking member and cam wheel.
Figure 8:
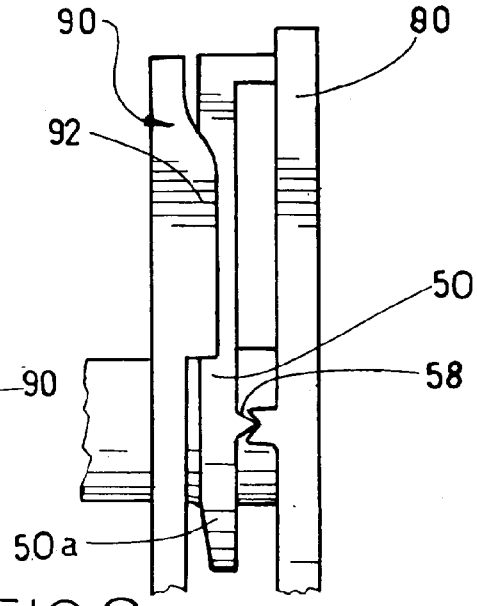
FIG. 8 is a partial side elevation of the blocking member and cam wheel.

The blocking member 50 is actuated by a rotatable member, in the preferred embodiment a cam disc 90 rotatably engaged to the shaft 32 at hub 96 and provided with a cam 92 disposed immediately upstream of the coin slot 24 when the mechanism 10 is in the rest position, as shown in FIG. 7. The cam wheel 90 is mounted behind the rocker bar 50, positioned close enough to the rocker bar 50 that when the cam disc 90 is rotated the cam 92 will force the rocker bar 50 forwardly so that the blade 52 projects through the notch 83 in the blocking position, as shown in FIG. 6. One or more springs 55 extending between the rocker bar 50 and the back plate 80 biases the rocker bar 50 against the cam disc 90, so that when the coin mechanism 10 is in the rest position shown in FIG. 5 the blade 52 remains retracted from the coin slot 24 until it is forced forwardly by the cam 92 upon rotation of the mechanism 10, as shown in FIG. 6.

In the preferred embodiment the rocker bar 50 is pivotably mounted about the hub 96 of the cam disc 90, which serves to prevent lateral displacement of the rocker bar 50 during normal use of the mechanism 10, and a fulcrum is provided by a pair of ribs 58 disposed on either side of the opening 54 which nest in complimentary channels 88 formed in the back plate 80 and thus space the rocker bar 50 from the back plate 80. To facilitate a full range of rocking motion, the rear surface of the rocker bar 50 beneath the opening 54 is bevelled, as at 50*a* (see FIGS. 5 and 6), allowing the rocker bar 50 to be pushed fully to the blocking position without the lower portion of the rocker bar 50 impinging into the space occupied by the cam disc 90.

Figure 9:
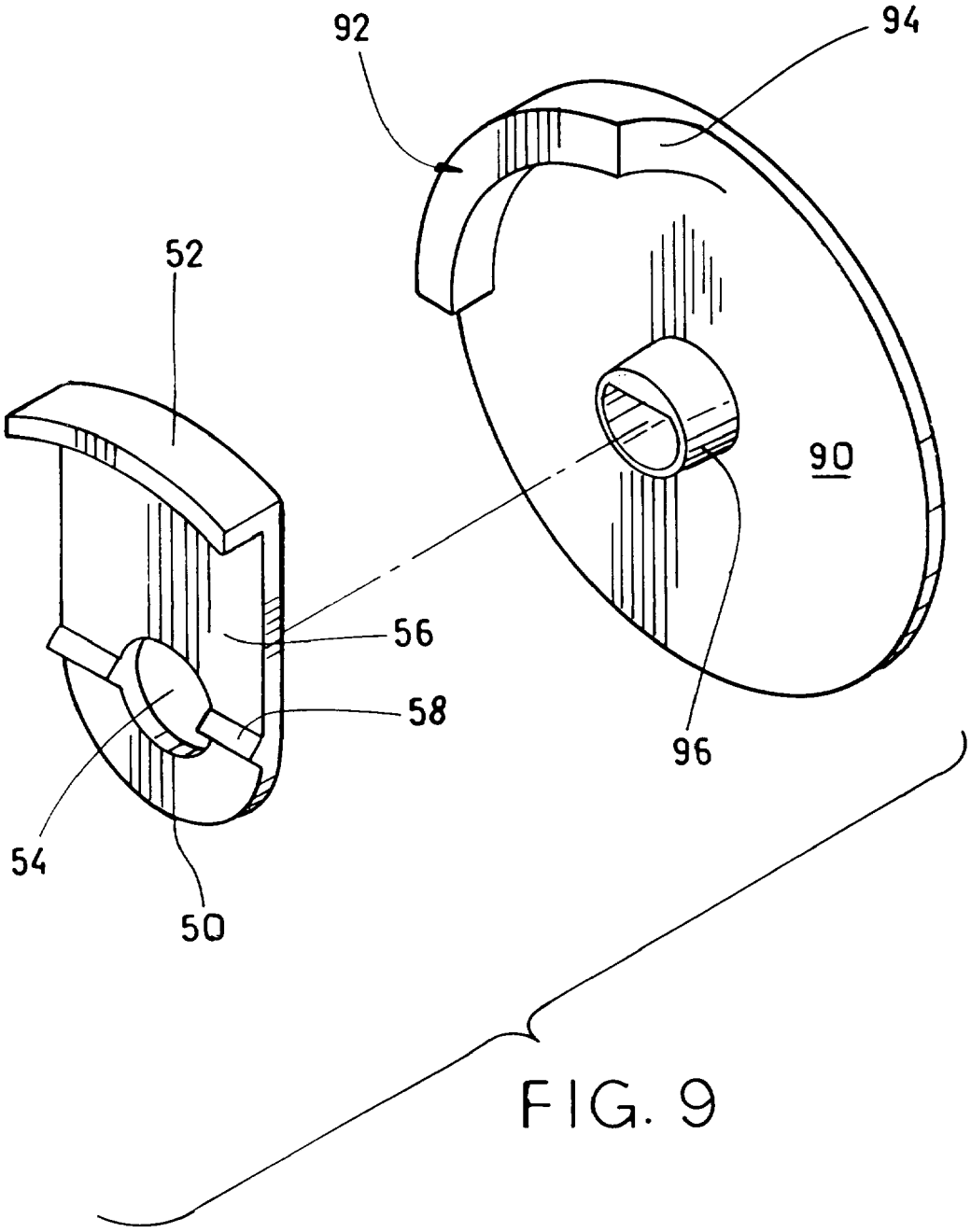
FIG. 9 is an exploded view of the blocking member and cam wheel.

Preferably the cam 92 is provided with a sloped leading portion 94, best seen in FIG. 9, to avoid abrupt contact between the cam 92 and the rocker bar 50. If desired the stem 56 of the rocker bar 50 may be slightly bent longitudinally, i.e. sloped laterally, to provide a ramp surface along which the leading portion 94 of the cam 92 can ride to reduce wear on the cam 92.

In operation, the coin mechanism 10 starts in the rest position illustrated in FIG. 5. As the handle 30 is turned the cam wheel 90 rotates and brings the cam 92 into contact with the rocker bar 50. The cam 92 forces the stem 56 of the rocker bar 50 forward, causing the blade 52 to extend forwardly out of the notch 83, as shown in FIG. 6. The blade 52 thus blocks access to the coin slot 24, to prevent a wire or other tool from being inserted through the coin slot 24 while the coin recess 42 is open to the measuring dog 34.

If the correct denomination of coin 1 has been deposited into the coin slot 24, the dogs 34, 70 will permit the coin conveyor 40 to rotate and the user can turn the handle 30 through the complete rotational cycle of the mechanism 10. Rotation of the handle 30 turns the shaft 32 and thus the drive gear 64, which rotates the dispensing wheel 6 to the next dispensing position to dispense merchandise to the user.

It will be appreciated that once the coin recess 42 has passed the diameter measuring dog 34 entirely, the mechanism has accepted the coin 1 and there is no longer any need to use a wire to defeat the measuring dog 34. Also, at this point in the rotational cycle the body of the coin conveyor 40 itself will block access through the coin slot 24 to the dog 34. The cam 92 therefore need be no longer than the width of the coin recess 42; after the coin 1 has been accepted and the coin recess 42 is no longer accessible through the coin slot 24, the rocker bar 50 can be permitted to return to the retracted position. If the coin is rejected, the blade 52 remains in the blocking position until the user allows the mechanism 10 to return (in reverse) to the rest position.

If a user attempts to stop the blade 52 from being forced over the coin slot 24 by the cam 92, rotation of the mechanism 10 will be arrested because the stem 56 of the rocker bar 50 will block the cam 92 and prevent the cam wheel 90, and thus the shaft 32, from rotating.

The invention having been thus described with reference to a preferred embodiment, it will be apparent to those skilled in the art that certain modifications and adaptations may be made without departing from the scope of invention, as set out in the appended claims.

I claim:

1. A coin mechanism comprising a cover plate having a coin slot, a coin conveyor having a coin recess in alignment with the coin slot when the coin conveyor is in a rest position, a handle for rotating the coin conveyor, engaged to a drive gear by a shaft, a measuring device for preventing rotation of the handle substantially beyond the rest position unless a coin of the correct size is deposited into the coin recess, and a blocking member biased to a rest position retracted from the coin slot and pivotable between the rest position and a blocking position in which the blocking member substantially covers the coin slot, the blocking member cooperating with a rotatable member which forces the blocking member into the blocking position upon rotation of the handle.

2. The coin mechanism of claim 1 in which the blocking member comprises a blade extending substantially across the coin slot.

3. The coin mechanism of claim 2 in which the blocking member comprises a rocker bar pivotably mounted about the shaft.

4. The coin mechanism of claim 3 in which the rocker bar is pivotably mounted about a hub of the rotatable member.

5. The coin mechanism of claim 2 in which in the rest position the blade extends into a slot in a stationary back plate fixed to the cover plate, to prevent rotation of the blocking member.

6. The coin mechanism of claim 1 in which the blocking member is biased to the rest position by a spring.

7. The coin mechanism of claim 1 in which the rotatable member comprises a cam having a rest position adjacent the blocking member, to contact the blocking member upon rotation of the handle.

8. The coin mechanism of claim 7 in which the cam projects from a cam disc rotatably fixed to the shaft.

9. The coin mechanism of claim 7 in which the cam is provided with a sloped leading portion.

10. The coin mechanism of claim 7 in which the cam has a length substantially equal to a length of the coin slot.

11. A vending machine having a coin mechanism, the coin mechanism comprising a cover plate having a coin slot, a coin conveyor having a coin recess in alignment with the coin slot when the coin conveyor is in a rest position, a handle for rotating the coin conveyor, engaged to a drive gear by a shaft, a measuring device for preventing rotation of the handle substantially beyond the rest position unless a coin of the correct size is deposited into the coin recess, and a blocking member biased to a rest position retracted from the coin slot and pivotable between the rest position and a blocking position in which the blocking member substantially covers the coin slot, the blocking member cooperating with a rotatable member which forces the blocking member into the blocking position upon rotation of the handle.

12. The vending machine of claim 11 in which the blocking member comprises a blade extending substantially across the coin slot.

13. The vending machine of claim 12 in which the blocking member comprises a rocker bar pivotably mounted about the shaft.

14. The vending machine of claim 13 in which the rocker bar is pivotably mounted about a hub of the rotatable member.

15. The vending machine of claim 12 in which in the rest position the blade extends into a slot in a stationary back plate fixed to the cover plate, to prevent rotation of the blocking member.

16. The vending machine of claim 11 in which the blocking member is biased to the rest position by a spring.

17. The vending machine of claim 11 in which the rotatable member comprises a cam having a rest position adjacent the blocking member, to contact the blocking member upon rotation of the handle.

18. The vending machine of claim 17 in which the cam projects from a cam disc rotatably fixed to the shaft.

19. The vending machine of claim 17 in which the cam is provided with a sloped leading portion.

20. The vending machine of claim 17 in which the cam has a length substantially equal to a length of the coin slot.

* * * * *